US011827965B2

(12) United States Patent
Mehta et al.

(10) Patent No.: US 11,827,965 B2
(45) Date of Patent: Nov. 28, 2023

(54) METALLIC GLASS COATING MATERIAL

(71) Applicants: The Board of Trustees of the Leland Stanford Junior University, Stanford, CA (US); Colorado School of Mines, Golden, CO (US)

(72) Inventors: Apurva Mehta, San Francisco, CA (US); Suchismita Sarker, Menlo Park, CA (US); Corinne E. Packard, Lakewood, CO (US); Rachel Schoeppner, Santa Barbara, CA (US)

(73) Assignees: The Board of Trustees of the Leland Stanford Junior University, Stanford, CA (US); Colorado School of Mines, Golden, CO (US)

( * ) Notice: Subject to any disclaimer, the term of this patent is extended or adjusted under 35 U.S.C. 154(b) by 0 days.

(21) Appl. No.: 17/869,720

(22) Filed: Jul. 20, 2022

(65) Prior Publication Data

US 2023/0030401 A1 Feb. 2, 2023

Related U.S. Application Data

(60) Provisional application No. 63/223,897, filed on Jul. 20, 2021.

(51) Int. Cl.
*C22C 45/02* (2006.01)
*C22C 45/10* (2006.01)

(52) U.S. Cl.
CPC ..... *C22C 45/02* (2013.01); *C22C 2200/02* (2013.01)

(58) Field of Classification Search
None
See application file for complete search history.

(56) References Cited

PUBLICATIONS

Yao (Applied Physics Letters, vol. 92, 2008, No. 251906). (Year: 2008).*
Chou, Journal of Non-Crystalline Solids, vol. 40, p. 417-428. (Year: 1980).*
Sarker et al., Discovering exceptionally hard and wear-resistant metallic glasses by combining machine-learning with high throughput experimentation, Jan. 10, 2022. Applied Physics Reviews (2022).
Joress et al., A High-Throughput Structural and Electrochemical Study of Metallic Glass Formation in Ni—Ti—Al, ACS Comb. Sci. 2020, 22, 7, 330-338. Jun. 4, 2020.
Ren et al., Accelerated discovery of metallic glasses through iteration of machine learning and high-throughput experiments, Science Advances, Apr. 13, 2018. vol. 4, Issue 4.

* cited by examiner

*Primary Examiner* — Xiaowei Su
(74) *Attorney, Agent, or Firm* — LUMEN PATENT FIRM

(57) ABSTRACT

A metallic glass coating material is composed of an alloy of Fe, B, and one of the metals Nb, Mo, Zr, or W. The ratios of Fe, B, and the metal are predetermined using machine learning predictions and high-throughput experiments. In one example, the material is an alloy of Fe, Nb, Mo and B, of the form $Fe_x(Nb, Mo)_yB_z$, where x is in the range 18-28, y is in the range 35-45, and z is in the range 32-42. In another example, the material may be the alloy $Fe_{23}(Nb, Mo)_{40}B_{37}$. The alloy may be doped with Zr and/or W, where the Zr and/or W comprises at most 10% of the alloy.

4 Claims, 4 Drawing Sheets

METALLIC GLASS COATING MATERIAL

CROSS-REFERENCE TO RELATED APPLICATIONS

This application claims priority from U.S. Provisional Patent Application 63/223,897 filed Jul. 20, 2021, which is incorporated herein by reference.

STATEMENT OF FEDERALLY SPONSORED RESEARCH

This invention was made with Government support under contract DE-AC02-76SF00515 awarded by the Department of Energy. The Government has certain rights in the invention.

FIELD OF THE INVENTION

The present invention relates generally to metallic glass coating materials, such as alloys of Fe, Nb, Mo and B.

BACKGROUND OF THE INVENTION

The omnipresence of structural components makes mechanical wear and tear, and the resulting performance and lifetime degradation, a topic of extreme importance. Manufacturing these components consumes a sizable portion of the energy and is a major contributor to carbon emission. Wear-resistant coatings on contact-components and cutting surfaces have the potential to not only improve mechanical performance by reducing surface deformation but also prolong operating life. Wear-resistant coatings can significantly impact the economy and the environment. For example, a 2017 report by Holmberg and Erdemir suggests that better surfaces on components can easily result in over trillion USD of savings annually.

Amorphous alloys, commonly called metallic glasses (MGs), provide a potential solution to this problem by promising to be better candidates for wear-resistant coatings than their crystalline counterparts. The lack of crystalline long-range periodicity removes traditional dislocation-based deformation pathways, allowing higher hardness, strength, and elastic strain limit. Unfortunately, finding alloy compositions with a high glass-forming likelihood is challenging. Finding one with additional property constraints such as high wear-resistance is even more difficult. Additionally, large numbers of known MGs contain scarce or expensive elements (e.g., Pd, Au, Ir), making them poor candidates for inexpensive coatings, let alone bulk structural components.

A recent computational study suggests that in multiple principal element alloys (MPEAs), entropy begins to dominate enthalpic effects as the number of principal elements increases, and disorder becomes more prevalent. Although all known MGs are MPEAs, only a small fraction of disordered MPEAs is glass-forming. The challenge is that in a search space defined by 25 inexpensive, earth-friendly elements, there are 300 binary systems, 2,300 ternary systems, and 12,650 quaternary systems and each of these higher dimensional systems contains hundreds if not thousands of possible alloy compositions. Thus, there are tens of millions of possible compositions to search for a likely glass-former. A blind search of the vast combinatorial space for MGs is intractable by traditional methods. The quasi-empirical rules for glass-formation such as higher likelihood near eutectic points, thermodynamic models, geometric packing factors, and atomic number fractions, although informative, provide insufficient predictive power to design new MGs. Moreover, there is no defined way to incorporate information from previous successful and failed experiments to improve predictions. Consequently, many MGs discovered over the last 60 years were through serendipity, which is not a reliable design strategy.

SUMMARY OF THE INVENTION

In one aspect, the invention provides a new class of metallic alloys that are four times harder and nearly two times more wear-resistant than stainless steel. These alloys can be sputtered on to a surface at room temperature. It is made from non-toxic materials and is relatively cheap to apply and has comparable electrical conductivity to graphite.

We also outline a machine-learning guided procedure to further improve the performance of these alloys. Relying on machine learning (ML) predictions of MGs alone requires a highly precise model; however, incorporating high-throughput (HiTp) experiments into the search rapidly leads to higher performing materials even from moderately accurate models. Here, we exploit this synergy between ML predictions and HiTp experimentation to discover new hard and wear-resistant MGs in the Fe—Nb—B ternary material system. Several of the new alloys exhibit hardness greater than 25 GPa, which is over three times harder than hardened stainless steel and only surpassed by diamond and diamond-like-carbon. This ability to use less than perfect ML predictions to successfully guide HiTp experiments, demonstrated here, is especially important for searching the vast Multi-Principal-Element-Alloy combinatorial space, which is still poorly understood theoretically and sparsely explored experimentally.

These techniques would be attractive for commercial applications from cutting surfaces (knives to machine tools), to contact surfaces (especially electrical connectors and brushes in electrical motors).

Advantages and improvements over existing methods, devices or materials is that the coatings of the present invention are cheaper, room temperature processable, and electrically conducting.

In one aspect, the invention provides a metallic glass coating material comprising an alloy of Fe, B, and one of the metals Nb, Mo, Zr, or W. The ratios of Fe, B, and the metal are predetermined using machine learning predictions and high-throughput experiments.

In another aspect, the invention provides a metallic glass coating material comprising an alloy of Fe, Nb, Mo and B, of the form $Fe_x(Nb, Mo)_yB_z$, where x is in the range 18-28, y is in the range 35-45, and z is in the range 32-42.

For example, the metallic glass coating material may be the alloy $Fe_{23}(Nb, Mo)_{40}B_{37}$. The alloy may be doped with Zr and/or W, where the Zr and/or W comprises at most 10% of the alloy.

DETAILED DESCRIPTION OF THE INVENTION

Lacking reliably predictive physiochemical models for discovering new metallic glasses with desirable properties, the inventors used machine learning (ML) to guide the search for a wear-resistant metallic glass. Specifically, an iterative approach combines ML with high throughput (HiTp) experiments to accelerate the discovery of new MGs by over 100-times. By training models on the weaknesses of predecessor models (boosting), every iteration resulted in improved glass-prediction accuracy for sputtered coatings. The model for glass-forming likelihood of arbitrary composition underwent two additional iterations of HiTp synthesis, testing, and retraining for improved accuracy. The next important step was developing a model to predict wear resistance. Although there are some computational reports relating the mechanical behavior of MGs to their free volume and local stresses (which activate interdependent shear transformation zones), there are no widely accepted physiochemical theories or clear empirical rules to predict hardness and wear-resistance of MGs. The classical theory of wear suggests hardness is closely correlated with wear resistance, but it is only one of the determinants. Most wear-resistant materials are hard, but not all hard materials are wear-resistant. Nevertheless, rejecting materials with low hardness allows shrinking of the search space for wear-resistant materials.

The inventors developed a model for hardness to guide a search towards finding wear-resistant MGs. The hardness and glass-formability models were similar in structure but trained independently. To develop the hardness model, a dataset of hardness for 491 MGs was compiled by manually extracting results from 125 publications. This dataset was used to train a Random Forest (RF) machine-learning model, using the Matminer feature set. Because of the greatly sparser training set for hardness, the feature set was pruned of invariant features to mitigate over-fitting (see methods section for details). Using both the glass-formability and MG hardness models, we extracted 4 desired characteristics for over 2000 ternary alloy systems composed of 25 earth-friendly elements. The 4 desired characteristics we picked were: the fraction of the ternaries predicted to be glass-forming, the fraction of the glass-forming region in each ternary yet to be explored, and the highest and the lowest predicted hardness for a ternary composition.

Figure 1:
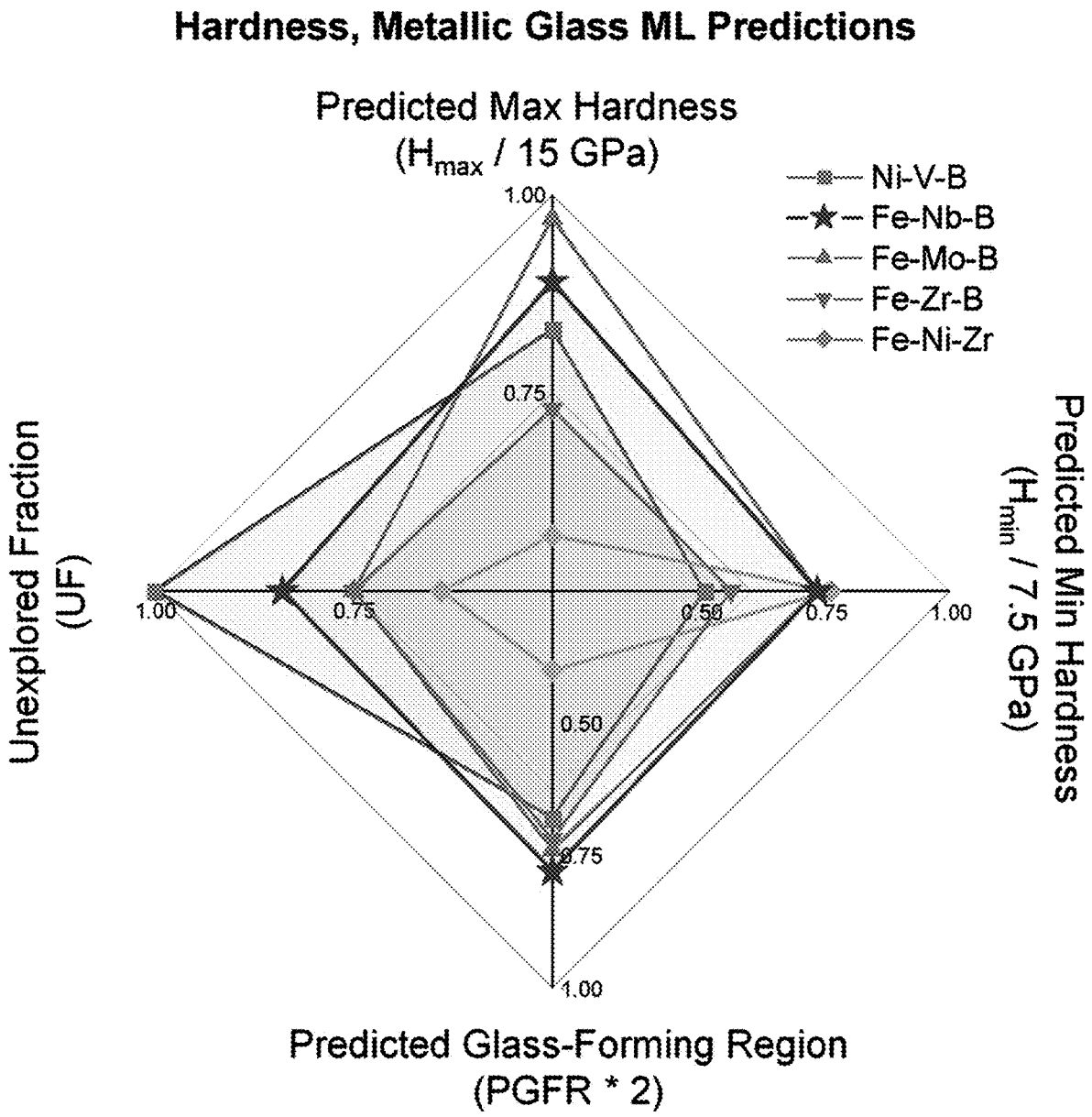
FIG. 1 is a graph of four characteristics for five candidate material systems that were predicted for exploration as metallic glass coatings, according to embodiments of the present invention.

FIG. 1 is a graph of these 4 characteristics for top 5 candidate MPEA ternary systems that ML predicted for exploration as metallic glass coatings. Each axis represents 4 desired characteristics of 5 ternary systems (individual axis are normalized 1 to reduce the complexity of the plot). Our model predicted over 250 ternary systems with non-zero glass-forming likelihood. It is interesting that Boron is a constituent of the top 4 of the 5 understudied glass-forming alloys; and is a promising inclusion for a search for hard MGs as many B compounds exhibit above average hardness. Furthermore, ¾ are Fe—B alloys with one of the three adjacent 2nd-row transition metals (TM=Zr, Nb, Mo). Fe—Nb—B and Fe—Mo—B emerged as ternaries with high values for all 4 of the desired characteristics. It is intriguing that even after over two decades of investigations in Fe—Nb—B ternary, the ML model indicates that the composition regions with the highest predicted hardness have not yet been explored. Therefore, we chose to focus our investigation on a full HiTp experimental exploration of the Fe—Nb—B ternary system.

We synthesized large regions of Fe—Nb—B ternary composition space simultaneously using combinatorial co-sputtering and employed high throughput (HiTp) characterization to rapidly map both the structure (glass-formability) and mechanical properties. Besides increasing the search speed, and providing prediction error tolerance, the HiTp approach simultaneously maps both the positive (desired) and the negative (undesired) regions of properties and consequently provides a more comprehensive view of the compositional space. We divided the ternary space into 15 overlapping composition spreads. We deposited each spread as a 500-800 nm thick film on a Si-substrate using multi-source magnetron co-sputtering and determined local composition using electron probe microanalysis (EPMA). HiTp x-ray diffraction (XRD) was performed at 44 discreet alloy compositions in each composition spread at a synchrotron beamline optimized for such measurements. The materials were classified into three categories by the width of the first sharp diffraction peak ($FWHM_{FSDP}$) as crystal ($FWHM_{FSDP}<0.4$ Å$^{-1}$), glass ($0.4<FWHM_{FSDP}<0.57$ Å$^{-1}$), and highly amorphous alloys ($FWHM_{FSDP}>0.57$ Å$^{-1}$).

Figures 2A, 2B, 2C:
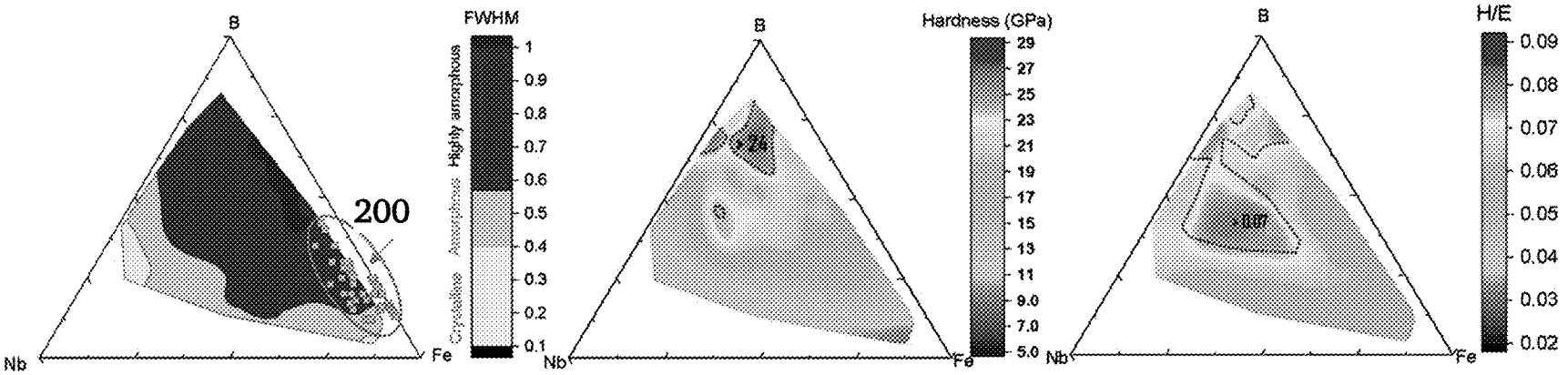
FIG. 2A graphs the variation in glass forming ability (GFA) within the Fe—Nb—B ternary material system as estimated by full-width half maximum (FWHM) of first sharp diffraction peak (FSDP)
FIG. 2B summarizes the mechanical hardness of Fe—Nb—B alloys obtained from nanoindentation measurements with substrate-effect corrections performed.
FIG. 2C summarizes the wear-resistance of Fe—Nb—B alloys obtained from nanoindentation measurements with substrate-effect corrections performed.

FIGS. 2A-C show experimentally measured properties of the Fe—Nb—B ternary system. FIG. 2A graphs the variation in glass forming ability (GFA) within the Fe—Nb—B ternary material system as estimated by full-width half maximum (FWHM) of first sharp diffraction peak (FSDP). The square data points in the region 200 represent alloys investigated over the last 50 years. We used the $FWHM_{FSDP}$ of amorphous silica ($FWHM_{FSDP}=0.57$ Å$^{-1}$) to define the cut-off threshold for the highly amorphous alloys. The MG community often classifies a material glass less stringently, using a threshold $FWHM_{FSDP}$ of 0.4 Å$^{-1}$. A very large region of the unexplored Fe—Nb—B ternary space, by either criterion, is experimentally confirmed to be amorphous and supports the overall predictions of the ML model. In our investigations of over 7,000 MGs to date, the newly explored Fe—Nb—B alloys exhibit some of the most amorphous materials. A few of the newly discovered alloys are nearly twice as amorphous ($FWHM_{FSDP}$) as prototypical silica glass (shown darkest). The SM shows diffraction patterns for two of the highly amorphous alloys.

FIGS. 2B-C summarize the mechanical hardness and wear-resistance properties of Fe—Nb—B alloys obtained from nanoindentation measurements with substrate-effect corrections performed. While measuring wear resistance directly is cumbersome, and is reported in few investigations of MG's, there is a considerable body of literature on estimating wear resistance based on hardness (H) and elastic modulus (E) with two common measures being H/E and $H^3/E^2$.

FIG. 2B shows hardness (H), and FIG. 2C shows the estimated wear-resistance as the ratio H/E. We found three composition regions displaying hardness greater than 24 GPa and estimated wear-resistance (H/E) greater than 0.07. The dotted contours in the figures, at H=24 GPa and H/E of 0.07, highlight these high-performing alloys. The highest hardness (29 GPa) was found for an Nb—B pseudo-binary alloy ($Fe_3Nb_{25}B_{72}$). The highest estimated wear-resistance (0.09) was found for an alloy with the composition $Fe_{20}Nb_{12}B_{68}$. We also found a composition region with similarly high wear-resistance centered at $Fe_{27}Nb_{27}B_{48}$, which is at the center of a large region in the middle of the Fe—Nb—B ternary space with estimated wear-resistance exceeding 0.07 and hardness ranging from 19-25 GPa.

Since the discovery in the 1970s of metallic glasses in the vicinity of $Fe_{80}B_{20}$, Fe-based alloys have set the benchmark for commercially viable MGs for structural applications. Previous explorations of Fe-based MG's have been confined to a small region of the Fe—Nb—B ternary space near the Fe-rich Fe—B binary leg. The highest hardness previously reported for this ternary is 16 GPa ($Fe_{56}Nb_8B_{36}$) and in this work, we report a hardness of 16.5 GPa for an almost identical composition ($Fe_{57}Nb_7B_{36}$). Higher hardness values were reported for Co-based MGs in 2011 which were quickly surpassed by W-based MGs in 2013 (H~24 GPa and H/E ~0.07). More recently, 8 element Fe-based MG systems (SAM1651 and SAM2X5) with a hardness of 15.7 GPa and 16.3 GPa respectively, have emerged as potential candidates for naval and nuclear storage applications. Many of the alloys reported here are better than metallic glasses in commercial use today.

Figure 3:
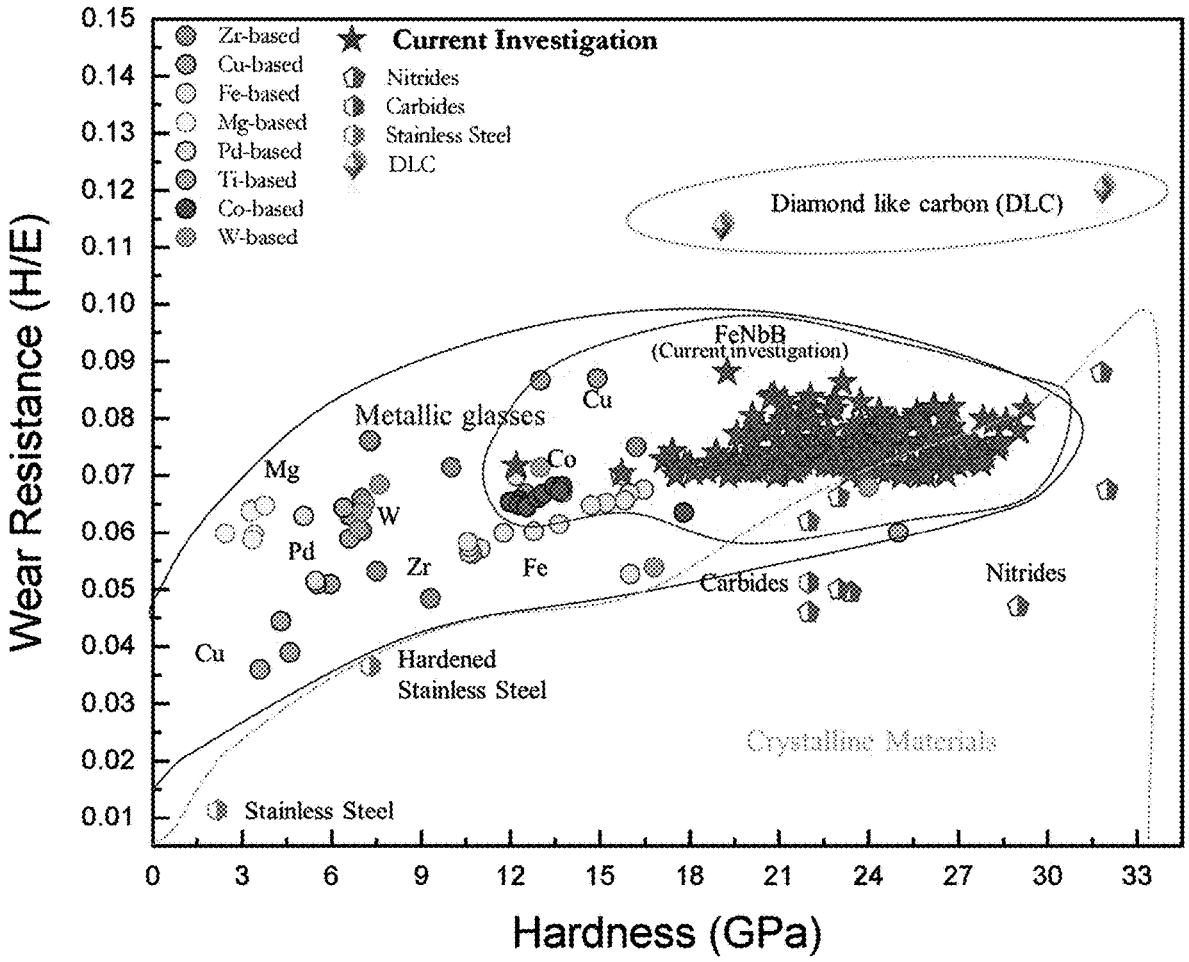
FIG. 3 is a wear-resistance versus hardness plot of various Fe—Nb—B alloys, comparing alloys discovered by the inventors with other wear-resistant amorphous and crystalline materials.

FIG. 3 is a wear-resistance versus hardness plot of various Fe—Nb—B alloys, comparing alloys discovered by the inventors (stars) with other wear-resistant amorphous (circles) and crystalline materials (pentagons). To ensure that the comparisons are consistent, all values reported in the figure are measured by nanoindentation. The stars indicate measurements with H/E>0.6 from this investigation. The hardness and wear-resistance of a large fraction of the Fe—Nb—B alloys investigated in this work not only surpass previously reported MGs but also are competitive with some of the best-reported wear-resistant coatings. These newly discovered alloys are 2-4 times harder and more wear-resistant than hardened stainless steel and comparable to nitride coatings. They are only surpassed by diamond and Diamond-like carbon (DLC) that have remarkably high wear-resistance but are far too expensive for wide-scale use. Furthermore, these alloys with superb wear-resistance are in a 3-element system. The inventors expect there is room for further improvement through alloying of additional elements as was done with 8-element SAM alloys.

The ML-HiTp approach used in this study outlines a path for higher performance alloys in higher dimensions. The HiTp experiments allow us to map large swaths of the composition space simultaneously. The HiTp flood-light searches highlight trends that are often missed in a smaller and less comprehensive one-alloy-at-a-time measurement approach. One such trend becomes evident in a comparison of FIG. 2A with FIG. 2B and FIG. 2C. Although there is a rough positive correlation between hardness and $FWHM_{FSDP}$ (as well as between elastic modulus and $FWHM_{FSDP}$) consistent with the conventional wisdom that MGs are harder than their crystalline counterparts, the correlation is far from perfect. For example, the hardest and most wear-resistant Fe—Nb—B alloys are not the most amorphous alloys observed in the system. Glassiness (or more precisely $FWHM_{FSDP}$) appears to be just one of the criteria needed for a hard and wear-resistant MG. Although the partial surrogate relation between glass-formability and hardness is useful in a hunt for hard MGs when training datasets of hardness are small and insufficiently diverse, ultimately a predictor of hardness independent of glass-formability is preferable. Similarly, most wear-resistant alloys are not the hardest, and ultimately a predictor of wear-resistance independent of hardness is desired.

Our discovery also highlights that many materials with outstanding properties often lie in composition spaces neighboring the ones that have been incrementally explored for decades. However, finding better performers in compositions "just around the corner" is not trivial, especially when the dimensionality of the search-space increases, as illustrated by the example of Nb doping of Fe—B alloys. Researchers have explored doping Fe—B MGs with Nb and other second-row TMs for decades, and in so doing have observed improved GFA but crystallization and degradation of mechanical performance sets in beyond a few at % Nb. Our results show that simply increasing Nb doping does not lead to better or harder glasses. Optimizing alloy compositions in the Fe—Nb—B ternary space requires adjusting the concentration of all three elements, and finding these multi-dimensional paths in the MPEA space without HiTp experimentation is nearly impossible.

Ultimately, the synergy between HiTp experimentation and ML enabled the discovery of these exceptional alloys within a sparsely explored combinatorial space. Employing one method without the other would have taken a prohibitive amount of time. In the absence of well-established physio-chemical theories or reliable empirical rules for wear-resistant MGs, exploring the MPEA space with HiTp experimentation alone at an unsustainable rate of one ternary per day every day would take 10 years. Guidance from ML models is essential in searching the vast MPEA space. Similarly, ML models trained on sparsely populated datasets such as those currently available for MPEA are unlikely to produce highly accurate predictions. However, the wide search swaths of HiTp experimentation are error-tolerant and result in new discoveries when ML models are only moderately accurate. Even mediocre models point roughly in the right direction, and more importantly often tell where not to look. Combining this guidance with search-light sweeps of HiTp experimentation is a very efficient means to search complex unknown spaces. Moreover, as was shown in our previous work on MGs, iteration of ML predictions with HiTp experiments rapidly improves the accuracy of subsequent generations of predictions. Mediocre models become better, as the quantity and diversity of the training data increases. The iteration of ML-guided HiTp explorations will guide the search for wear resistant MGs through increasingly higher dimensional MPEA space faster and with progressively better accuracy and precision.

Given the limited size and diversity of the hardness training set, it is not surprising that ML predictions underestimate our observations considerably. However, this underestimation also reflects the tendency of Random Forest Regressors (RFR) to predict values within the bounds of its training set. They are better at interpolation than extrapolation and always underpredict record-breaking findings. The observations reported here match the RF prediction for low to moderate hardness well, but the discrepancy increases as the observed hardness increases (as shown in SM). The conservative nature of RFR predictions makes it a safer guide for searching experimentally expensive spaces, as there is a reasonable likelihood that the search will at minimum result in discoveries matching the predictions and pose a chance of exceeding predictions as was, fortunately, the case here.

In conclusion, here we report the discovery of earth-friendly MGs in the Fe—Nb—B ternary material system attractive for commercially viable wear-resistant coatings. We discovered several hard and wear-resistant compositions that exhibit hardness greater than 25 GPa, which is >3× larger than hardened stainless steel and wear resistance comparable to best commercial nitride coatings. This study also illustrates how machine-learning-guided high throughput experimentation can improve on best-known materials and quickly lead to superior ones in highly complex composition-processing spaces. The proposed approach is not limited to only finding wear-resistant MG compositions but can be readily applied to searching the complex composition spaces and synthesis pathways leading to other MG functionalities or properties such as high glass transition temperature, or exploration of crystallization kinetics. The approach can even be adapted to rapidly find new catalysts, thermoelectric, and other desired materials in the vast MPEA design space.

Figure 4:
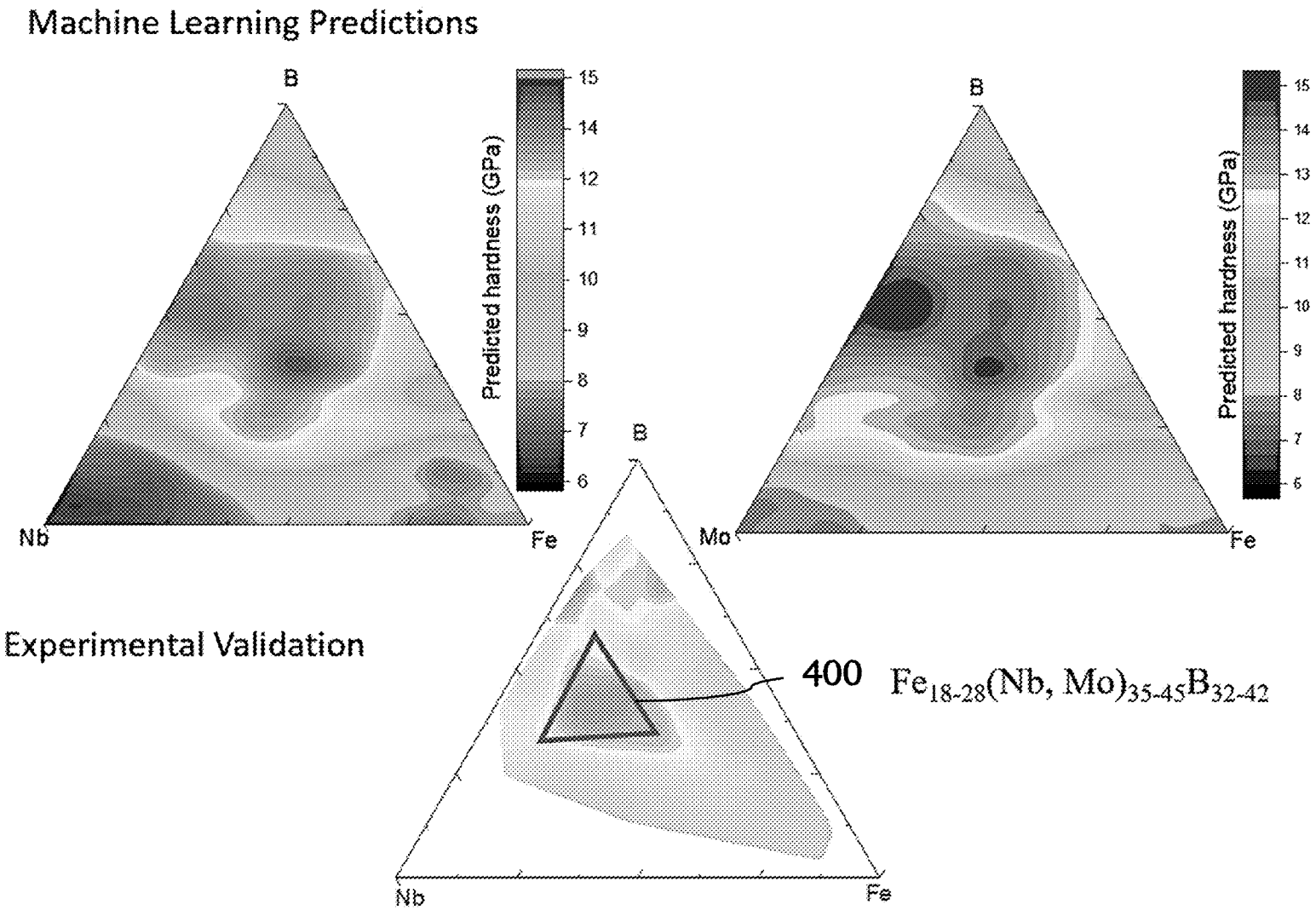
FIG. 4 is a graph showing a class of materials discovered by the inventors having remarkable hardness and wear-resistance comprising an alloy of Fe, Nb, Mo and B, of the form $Fe_x(Nb, Mo)_yB_z$, with predetermined ranges for the values of x, y, z.

Although the above examples and discussion focus on the Fe—Nb—B material system, investigations by the inventors show that certain closely related material systems have similar properties. In particular, a metallic glass coating material with desirable hardness and wear-resistance may also be composed of an alloy of Fe, B, and Mo, Zr, or W. Substituting Mo for Nb is expected to result in nearly equivalent properties. An alloy may also contain a combination of Mo and Nb with Fe and B. In particular, a metallic glass coating material comprising an alloy of Fe, Nb, Mo and B, of the form $Fe_x(Nb, Mo)_yB_z$, where x is in the range 18-28, y is in the range 35-45, and z is in the range 32-42, as illustrated by the region 400 in FIG. 4. Particularly desirable alloys, for example, are $Fe_{23}(Nb, Mo)_{40}B_{37}$. In addition, the alloy may be doped with Zr and/or W, where the Zr and/or W represents at most 10% of the alloy.

The Fe—Nb—B system has been extensively explored for last two decades, but region 400 with far superior properties was completely overlooked, with most of the exploration focused on incremental improvement of region 200 (FIG. 2A). The model developed by the inventors was key to the discovery of region 400. Similarly some of the MGs in the higher composition-spaces than Fe—Nb—B, for example in the 6-dimension Fe—Nb—Mo—W—Zr—B, would almost certainly have enhanced performance over MGs in region 400 and even has the potential to surpass performance of diamond-like-carbon. Some of these alloys may also possess high resistance to corrosion and find even broader applicability. However, only a few regions in the higher dimensions will be better, and a vast portion of the remaining region no better and even worse. Finding these desired, but buried compositions becomes exponentially more difficult on addition of every new dimension. The model described herein can be used to determine these hidden materials with orders magnitude acceleration.

Methods

Database Creation. To create a mechanical property database, we assembled ~430 publicly available metallic glass manuscripts. Out of 430 manuscripts, the hardness training set was created based on 130 manuscripts that contain 491 hardness datapoints. The training data for the glass-forming likelihood contained 6139 observations distributed over 313 systems. These databases are available through the Materials Data Facility.

Machine Learning.

We trained two separate Random Forest models to predict glass formability and hardness in similar ways. Compositions from each dataset were given a physics-based feature set provided by the Matminer package. The model hyperparameters were optimized on this feature set using 10-fold cross-validation, and the best performing model was trained on the entire available dataset. In particular, the maximum number of features and number of estimators per split was set to 10 features, 256 estimators for the metallic glass model and 12 features, and 100 estimators for the hardness model. Invariant features were pruned from the hardness feature set before training to improve performance and prevent overfitting, while the model for glass-forming likelihood (GFL) via sputtering used a full feature set. However, the GFL model for this work went through two additional iterations of experimentation, testing, and retraining. All models were implemented in Python using scikit-learn.

Predictions were made using these models on a grid of 1326 compositions per ternary system. These compositions were equally spaced across a ternary phase diagram. Over 2000 ternary systems were predicted and ranked by both hardness and glass-forming probability.

Sample preparation. The Fe—Nb—B thin-film compositional spreads were deposited from 2-inch Fe, Nb, and B targets on unheated 2×2-inch Si-wafers using combinatorial magnetron co-sputtering instrument with $<1\times10^{-6}$ torr base pressure-filled with Ar (10 mTorr). The composition spread was controlled by applying different gun powers in the 20-80 W range, and the thickness of the deposited film varied in the 500-800 nm range.

Composition Measurements. The composition map was determined by wavelength dispersive spectroscopy (WDS) analysis in an electron probe microanalyzer (EPMA) JXA 8900R Microprobe, with an acceleration voltage of 15 kV. Standardization of references was carried out with pure metal references and compositions were determined to be within an experimental error of <0.3 at %. WDS was selected over energy dispersive spectroscopy (EDS) due to its higher accuracy and precision in quantifying elemental content via better energy resolution from peak/background ratio.

Structural characterization. The structural characterization was performed at beamline 1-5 at Stanford Synchrotron Radiation Lightsource (SSRL) using the two-dimensional XRD (MarCCD 165) detector. The XRD patterns were collected with 15.5-keV energy X-rays. To minimize diffraction from the silicon substrate, the samples were aligned to the incident beam at a grazing angle of 2°. The grazing incidence geometry resulted in an approximate 3-mm probe footprint on the samples. A $LaB_6$ powder diffraction pattern was used to extract diffraction geometric parameters, for instance, direct beam position, tilting, rotation, and sample-to-detector distance. These parameters were used to transform initial 2-D raw images to Q and $\chi$ diffraction coordinate and then into 1D diffraction patterns by integrating and normalizing over the x angle by using custom python scripts.

Mechanical characterization and analysis. Experiments were performed on a Hysitron (now Bruker) TI 950 with NanoDMA III at a frequency of 200 Hz with a maximum load of 10 mN to measure hardness (H) and modulus (E) at a constant strain rate of 0.12 $s^{-1}$ with a diamond, Berkovich-geometry nanoindenter tip, calibrated on fused quartz according to standard procedures. Thickness for each composition was measured by contact profilometry and used for subsequent data correction to remove the substrate compliance effect. The Li & Vlassak method was used for substrate correction of both Er and H and was implemented with some computational differences to streamline for parallel data processing. Four indentation tests were conducted on each composition and indentations were spaced at least 15 microns apart to ensure minimal overlap of indentation stress fields. We have used best practices for calibration of load frame compliance and tip area function, including using standard calibration materials, routine calibration checks throughout testing, and replacement of the tip when tip blunting causes insufficient plastic deformation in calibration standards at the indentation depths of interest. Calibration checks were performed daily in the study and the tip was replaced with a new, low radius of curvature indenter tip multiple times throughout the project, owing to tip blunting caused by repeatedly indenting materials with H>15 GPa. Elastic modulus reported here was $E_r$, the substrate-effect-corrected reduced modulus, which is defined as:

$$\frac{1}{E_r} = \frac{(1 - v_{indenter}^2)}{E_{indenter}} + \frac{(1 - v_{sample}^2)}{E_{sample}}$$

The invention claimed is:

1. A metallic glass coating material comprising an alloy of Fe, Nb, Mo and B, of the form $Fe_x(Nb, Mo)_yB_z$, where x, y, z specify atomic ratios, x is in the range 18-28, y is in the range 35-45, and z is in the range 32-42.

2. The metallic glass coating material of claim 1 where the alloy is $Fe_{23}(Nb, Mo)_{40}B_{37}$.

3. A metallic glass coating material comprising an alloy of Fe, Nb, Mo and B doped with Zr, where the alloy without Zr is of the form $Fe_x(Nb, Mo)_yB_z$, where x, y, z specify atomic ratios, x is in the range 18-28, y is in the range 35-45, and z is in the range 32-42, where the Zr comprises at most 10 at. % of the alloy.

4. A metallic glass coating material comprising an alloy of Fe, Nb, Mo and B doped with W, where the alloy without W is of the form $Fe_x(Nb, Mo)_yB_z$, where x, y, z specify atomic ratios, x is in the range 18-28, y is in the range 35-45, and z is in the range 32-42, where the W comprises at most 10 at. % of the alloy.

* * * * *